US007128013B1

(12) United States Patent
Plunkett et al.

(10) Patent No.: US 7,128,013 B1
(45) Date of Patent: Oct. 31, 2006

(54) LAUNCH TUBE SYSTEM HAVING INFLATABLE BLADDER SHOCK ISOLATION

(75) Inventors: Stephen J. Plunkett, Middletown, RI (US); Richard E. Dooley, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/240,783

(22) Filed: Sep. 26, 2005

(51) Int. Cl.
*B63B 1/00* (2006.01)

(52) U.S. Cl. ..... 114/238; 89/1.81; 89/1.806; 89/1.816

(58) Field of Classification Search ..... 114/238–239; 89/1.8, 1.801, 1.804, 1.806, 1.809, 1.81, 89/1.812, 1.816
See application file for complete search history.

(56) References Cited

U.S. PATENT DOCUMENTS 3,857,321 A * 12/1974 Cohen ..... 89/1.81
4,616,554 A * 10/1986 Spink et al. ..... 89/1.806
4,627,327 A * 12/1986 Huber ..... 89/1.816
6,382,123 B1 * 5/2002 Grondin ..... 114/238
6,526,860 B1 * 3/2003 Facciano et al. ..... 89/1.801

* cited by examiner

*Primary Examiner*—Michael J. Carone
*Assistant Examiner*—Gabriel J. Klein
(74) *Attorney, Agent, or Firm*—James M. Kasischke; Jean-Paul A. Nasser; Michael P. Stanley

(57) ABSTRACT

A launch tube system has two concentric sleeves. An inner sleeve having holes formed therethrough defines a launch tube, and an outer sleeve surrounds the inner sleeve and is spaced apart therefrom. One or more flexible bladders are disposed between the inner outer sleeves. When filled with fluid, the flexible bladder(s) expands and extends into and through the holes and into confines of the inner sleeve to thereby form shock isolation for a projectile housed in the inner sleeve.

20 Claims, 2 Drawing Sheets

LAUNCH TUBE SYSTEM HAVING INFLATABLE BLADDER SHOCK ISOLATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to shock isolation in launch tubes, and more particularly to a launch tube system that uses an inflatable bladder to provide shock isolation.

(2) Description of the Prior Art

Underwater shock is a major consideration when designing underwater launch tubes. In the past, elastomeric or polymeric materials have been permanently bonded to the inside surfaces of launch tubes to provide shock isolation around the circumference of a projectile (e.g., weapon, sensor system, etc.) loaded in the launch tube. The bonded material remains permanently in the launch tube and often interferes with or restricts the amount of exhaust that can be vented from the launch tube during a launch event. Also, when launch tube designs require the tandem, vertical stacking of projectiles, projectiles further down in the stack may have trouble clearing all the bonded shock isolation materials in the launch tube without experiencing velocity reduction.

SUMMARY OF THE INVENTION

Accordingly, it is an object of the present invention to provide a launch tube system utilizing shock isolation of a non-permanent nature.

Other objects and advantages of the present invention will become more obvious hereinafter in the specification and drawings.

In accordance with the present invention, a launch tube system has shock isolation for a projectile housed therein. Two concentric sleeves are utilized with an inner sleeve defining a launch tube and an outer sleeve surrounding the inner sleeve and spaced apart therefrom. The inner sleeve has a plurality of holes formed therethrough. One or more flexible bladders are disposed between the inner outer sleeves. A fluid under pressure is introduced into the flexible bladder(s). When filled with the fluid, the flexible bladder(s) expands and extends into and through the holes and into confines of the inner sleeve to thereby form shock isolation for a projectile housed in the inner sleeve.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
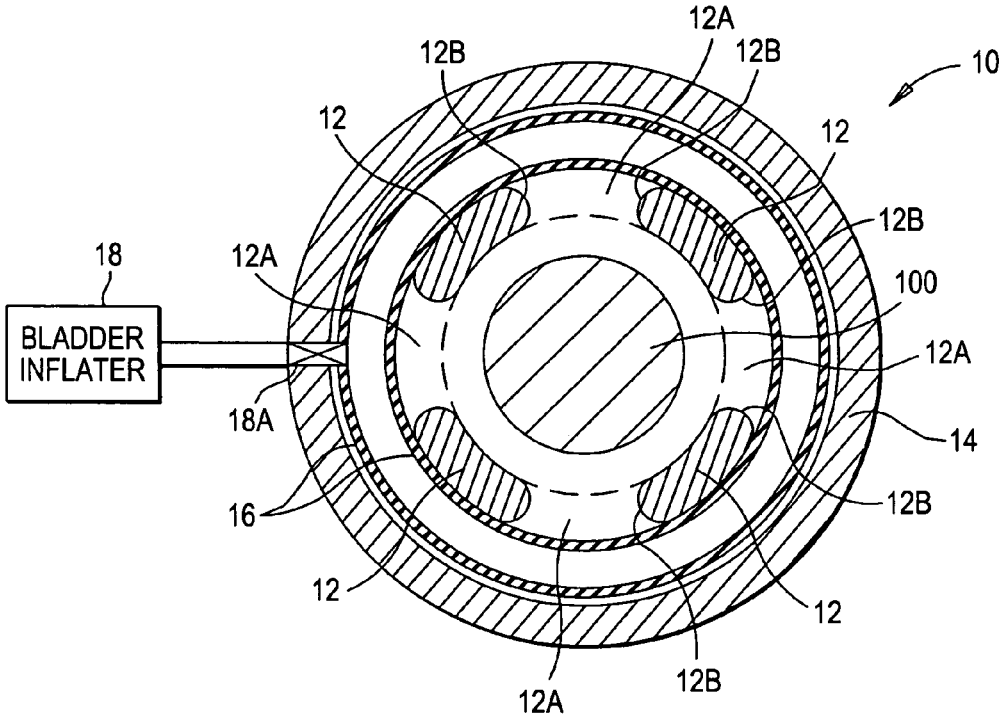
FIG. 1 is a cross-sectional view of a launch tube system prior to the filling of the system's bladder in accordance with an embodiment of the present invention.

Referring now to the drawings, and more particularly to FIG. 1, a cross-sectional view of a launch tube system in accordance with the present invention is shown and is referenced generally by numeral 10. Launch tube system 10 houses a projectile 100 prior to and during the launch thereof. The type of projectile 100 is not a limitation of the present invention. Accordingly, projectile 100 can be any size/configuration, and could be weapon or non-weapon based without departing from the scope of the present invention. Further, the type of launch system used to expel projectile 100 from launch tube system 10 is not a limitation of the present invention.

Launch tube system 10 generally includes an inner tube or sleeve 12, an outer tube or sleeve 14, a sealed bladder 16, and a bladder inflator 18. More specifically, inner sleeve 12 and outer sleeve 14 are concentric sleeves with inner sleeve 12 serving as a launch tube for projectile 100. Typically, sleeves 12 and 14 are made of a rigid material, the choice of which is not a limitation of the present invention.

Inner sleeve 12 has a plurality of holes 12A formed or cut therethrough with edges 12B (defining holes 12A) so-formed or cut typically being rounded as illustrated. In the illustrated example, holes 12A are elongated slots that extend axially along inner sleeve 12. However, the present invention is not so limited as the slots could also extend diagonally or transversely with respect to the axial dimension of sleeve 12. Still further, the number and/or size of holes 12A can be different than that shown. That is, the holes in sleeve 12 could have other geometries without departing from the scope of the present invention. The holes in sleeve 12 can be evenly distributed about inner sleeve 12 as shown or could be placed in strategic locations around sleeve 12 for a particular application without regard to an even distribution thereof.

Outer sleeve 14 is spaced apart from inner sleeve 12 such that a gap is formed therebetween. Fitted in this gap is bladder 16 made from a flexible material such as an elastomeric material or a composite fabric material. In FIG. 1, bladder 16 is in its deflated state. Bladder inflator 18 is coupled to the interior volume of bladder 16 through, for example, a valve 18A. Bladder inflator 18 can any number of gas or liquid sources such as a pump, compressor, bladder, generator or storage tank, or the like.

Figure 2:
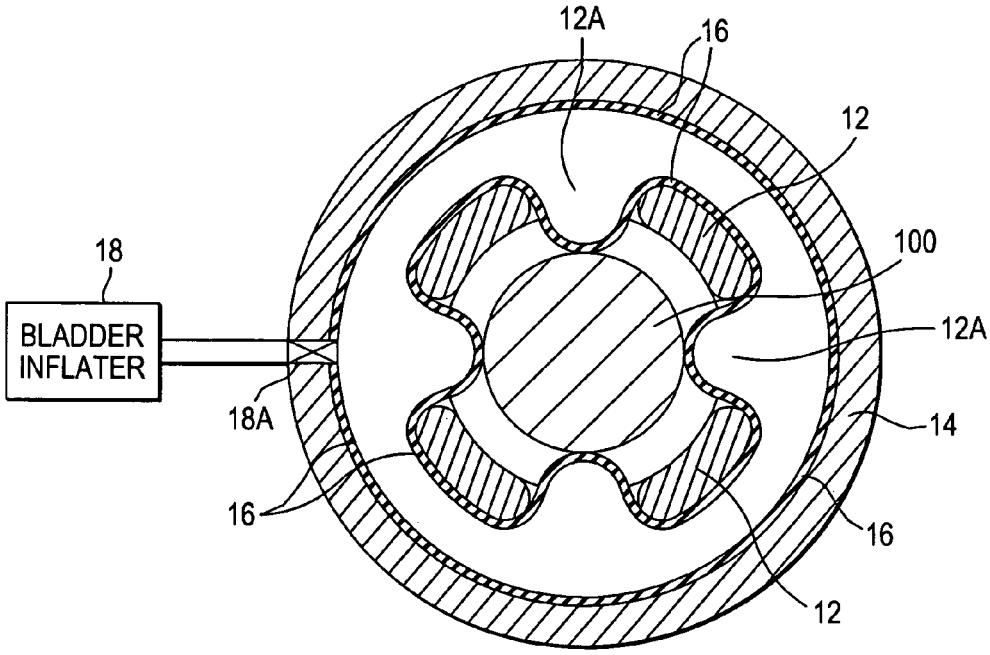
FIG. 2 is a cross-sectional view of the launch tube system of FIG. 1 after the filling of the system's bladder.
Figure 3:
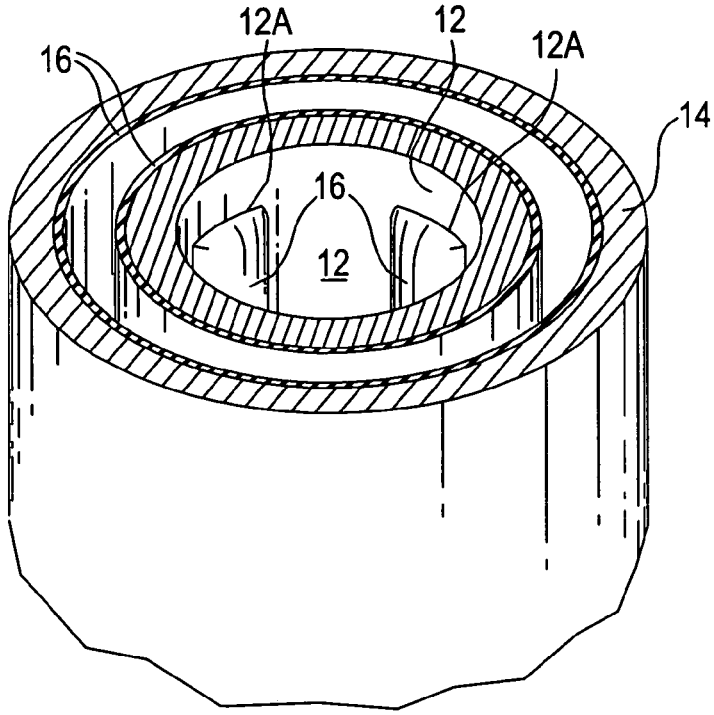
FIG. 3 is a perspective view of a portion of the launch tube system's inner and outer sleeves after the filling of the system's bladder illustrated without a projectile in the system's inner sleeve.

In operation, projectile 100 is loaded into inner sleeve 12 with bladder 16 in its deflated state shown in FIG. 1. Once loaded, bladder inflator 18 is activated, and valve 18A is opened to inflate/fill bladder 16 with a fluid. As bladder 16 fills and eventually becomes filled with the fluid, bladder 16 expands and extends through holes 12A as shown in FIGS. 2 and 3. (FIG. 3 does not illustrate projectile 100 for clarity of illustration.) The size and flexibility of bladder 16 is such that portions of inflated/filled bladder 16 (FIGS. 2 and 3) expand into inner sleeve 12 (through holes 12A) to engage the exterior surface of projectile 100 (FIG. 2). Thus, filled bladder 16 serves as shock isolation for the engaged projectile 100. When projectile 100 is to be launched, bladder inflator 18 is reversed and fluid in bladder 16 is expelled therefrom until bladder 16 deflates sufficiently so that projectile 100 can be launched without being restricted by bladder 16.

Bladder 16 can be realized by a single annular bladder that encircles inner sleeve 12 as illustrated. However, the present invention could also be realized using several bladders with each one thereof being aligned with a single one or several of holes 12A. Such individual bladders could be linked for filling with a single bladder inflator 18, or could be coupled to a corresponding number of independent bladder inflators.

Figure 4:
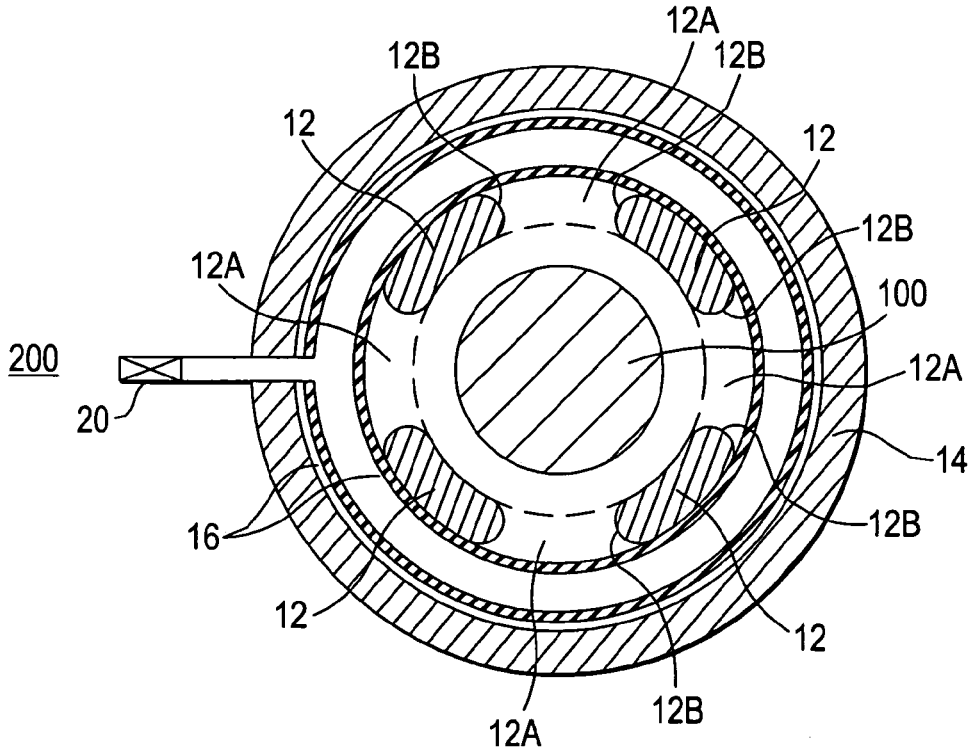
FIG. 4 is a schematic view of a simple, single-valve system for filling the launch tube system's bladder with seawater.

In terms of using the present invention for underwater launch scenarios, FIG. 4 schematically illustrates a simple bladder inflation embodiment of the present invention. When the launch tube system of the present invention utilizes a single annular bladder (e.g., bladder 16) and will operate underwater with the surrounding seawater environment 200 having a pressure that is greater than that inside (a deflated) bladder 16, the filling of bladder 16 can be accomplished using a single valve 20. More specifically, valve 20 is positioned such that, when opened, seawater 200 passes through valve 20 and into bladder 16 due to the pressure differential thereby inflating/filling bladder 16 as described above. Once the filled bladder 16 engages projectile 100 (through holes 12A), valve 20 is closed. The build up of strain energy in filled bladder 16 can be used to at least partially deflate bladder 16 when valve 20 is again opened. Alternatively, a vacuum pump (not shown) can be coupled to valve 20 to increase the speed of bladder deflation.

The advantages of the present invention are numerous. The launch tube system is easy to fabricate, simple to operate, and can be adapted to a variety of launch tube sizes and configurations. The shock isolation provided by the present invention is not permanent and can easily be removed from the confines of the launch tube to accommodate loading and launches.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A launch tube system having shock isolation for a projectile housed therein, comprising:

an inner sleeve defining a launch tube, said inner sleeve having a plurality of holes formed therethrough;

an outer sleeve surrounding said inner sleeve and spaced apart therefrom;

flexible bladder means disposed between said inner sleeve and said outer sleeve; and means for introducing a fluid under pressure into said flexible bladder means wherein, when filled with the fluid, said flexible bladder means expands and extends into and through said holes and into confines of said inner sleeve.

2. A launch tube system as in claim 1 wherein said inner sleeve and said outer sleeve are rigid.

3. A launch tube system as in claim 1 wherein said holes are evenly distributed about said inner sleeve.

4. A launch tube system as in claim 1 wherein said means for introducing a fluid under pressure comprises:

a bladder inflator to provide a fluid under pressure; and a valve positioned between said bladder inflator and said flexible bladder for selectively providing fluid to said flexible bladder.

5. A launch tube system as in claim 1 wherein said inner sleeve defines rounded edges that form the periphery of each of said holes.

6. A launch tube system as in claim 1 wherein said flexible bladder means comprises at least one flexible bladder made from a material selected from the group consisting of elastomeric materials and composite fabric materials.

7. A launch tube system as in claim 1 wherein said flexible bladder means comprises a single annular bladder made from a material selected from the group consisting of elastomeric materials and composite fabric materials.

8. A launch tube system as in claim 1 wherein the fluid is seawater, and wherein said means for introducing the fluid comprises a valve in communication with the seawater and an interior volume of said flexible bladder means wherein, when said valve is opened, the seawater is introduced into said flexible bladder means.

9. A launch tube system having shock isolation for a projectile housed therein, comprising:

an inner sleeve defining a launch tube, said inner sleeve having a plurality of slots formed therethrough and evenly distributed about said inner sleeve; and an outer sleeve surrounding said inner sleeve and spaced apart therefrom;

an annular flexible bladder disposed between said inner sleeve and said outer sleeve; and means for introducing a fluid under pressure into said flexible bladder wherein, when filled with the fluid, said flexible bladder expands and extends into and through said slots and into confines of said inner sleeve.

10. A launch tube system as in claim 9 wherein said inner sleeve and said outer sleeve are rigid.

11. A launch tube system as in claim 9 wherein said slots extend axially along the length of said inner sleeve.

12. A launch tube system as in claim 9 wherein each of said slots is identically sized.

13. A launch tube system as in claim 9 wherein said inner sleeve defines rounded edges that form the periphery of each of said slots.

14. A launch tube system as in claim 9 wherein said flexible bladder is made from a material selected from the group consisting of elastomeric materials and composite fabric materials.

15. A launch tube system as in claim 9 wherein the fluid is seawater, and wherein said means for introducing the fluid comprises a valve in communication with the seawater and an interior volume of said flexible bladder wherein, when said valve is opened, the seawater is introduced into said flexible bladder.

16. A launch tube system having shock isolation for a projectile housed therein, comprising:

a rigid inner sleeve defining a launch tube, said inner sleeve having a plurality of slots formed therethrough and evenly distributed about said inner sleeve;

a rigid outer sleeve concentrically disposed about said inner sleeve and spaced apart therefrom;

an annular flexible bladder disposed between said inner sleeve and said outer sleeve; and a valve adapted to be in communication with seawater at a pressure greater than that of an interior volume of said flexible bladder, said valve further being in communication with said interior volume of said flexible bladder wherein, when said valve is opened, the seawater is introduced into said flexible bladder to thereby cause said flexible bladder to expand wherein said flexible bladder extends into and through said slots and into confines of said inner sleeve.

17. A launch tube system as in claim 16 wherein said slots extend axially along the length of said inner sleeve.

18. A launch tube system as in claim 16 wherein each of said slots is identically sized.

19. A launch tube system as in claim 16 wherein said inner sleeve defines rounded edges that form the periphery of each of said slots.

20. A launch tube system as in claim 16 wherein said flexible bladder is made from a material selected from the group consisting of elastomeric materials and composite fabric materials.

* * * * *